United States Patent [19]

Chernack

[11] Patent Number: 4,838,441

[45] Date of Patent: Jun. 13, 1989

[54] CHILD RESISTANT CLOSURE

[76] Inventor: Milton P. Chernack, 399 June Pl., W. Hempstead, N.Y. 11552

[21] Appl. No.: 180,220

[22] Filed: Apr. 11, 1988

[51] Int. Cl.[4] ..... B65D 55/02

[52] U.S. Cl. ..... 215/216; 215/211; 215/301; 215/237; 215/235; 222/153

[58] Field of Search ..... 215/216, 235, 237, 3, 215/301, 211; 222/153

[56] References Cited

U.S. PATENT DOCUMENTS

| | | | |
|---|---|---|---|
| 4,022,352 | 5/1977 | Pehr | 222/153 |
| 4,533,058 | 8/1985 | Uhlig | 215/301 |
| 4,629,081 | 12/1986 | McLaren | 215/237 |
| 4,718,567 | 1/1988 | La Vange | 215/216 |
| 4,723,669 | 2/1988 | Barriac | 215/235 |

*Primary Examiner*—George T. Hall

*Attorney, Agent, or Firm*—Schechter, Brucker & Pavane

[57] ABSTRACT

An improved child resistant closure for a container comprises a base fixedly securable to the container, the base having an orifice communicating with an opening defined by the neck of the container and a first engaging means, a cover having a second engaging means, one of the cover and the base having a deformable portion, such that the cover is moveable between a closed position wherein the cover obturates the orifice in the base and wherein the first and second engaging means are engaged for retaining the cover in the closed position, and an open position when the orifice is exposed for dispensing the contents from the container, the cover being moveable to the open position by deforming the deformable portion which serves to disengage the first and second engaging means.

16 Claims, 6 Drawing Sheets

FIG. 3
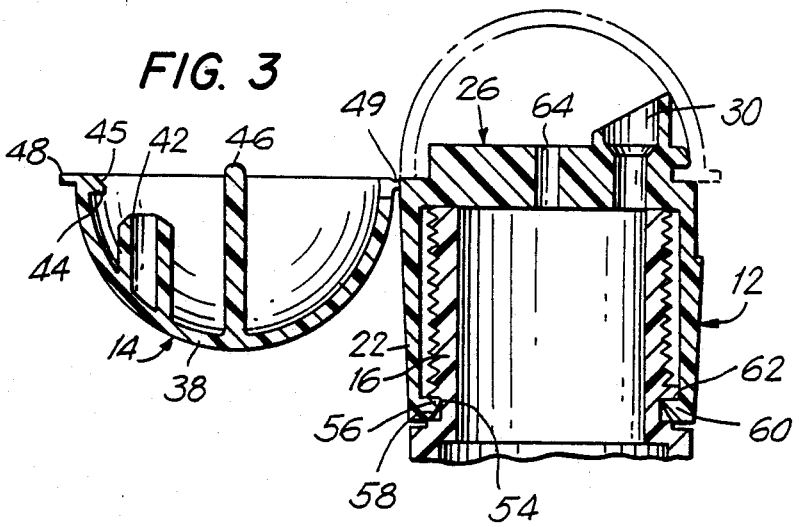
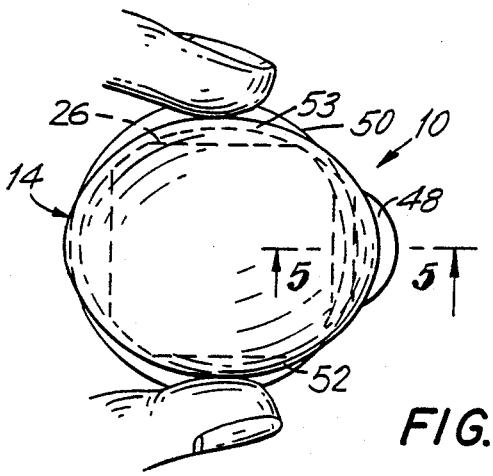
FIG. 4
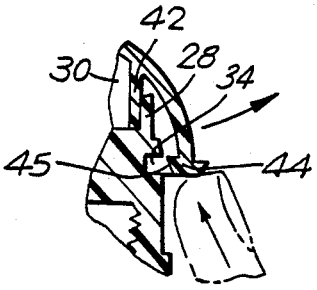
FIG. 5

FIG. 6
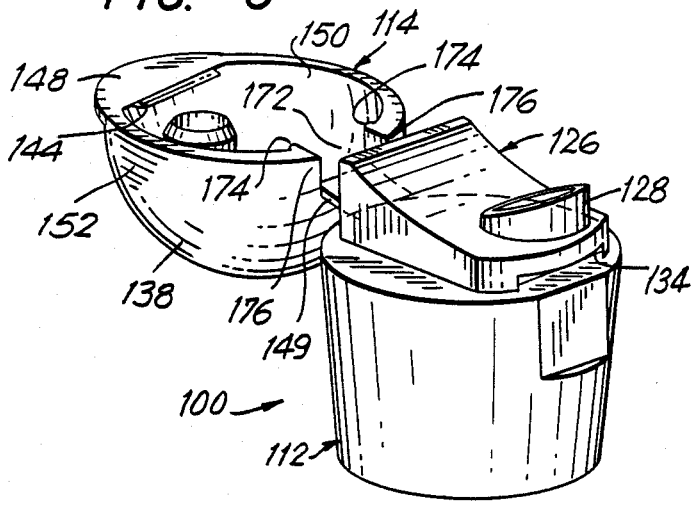
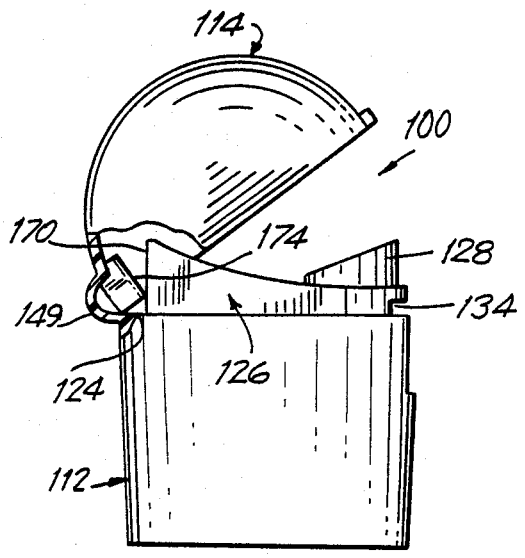
FIG. 7
FIG. 8
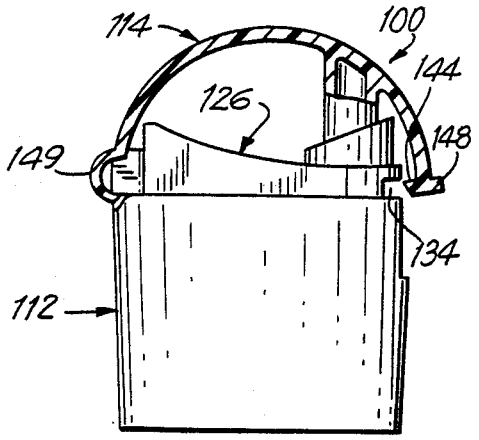

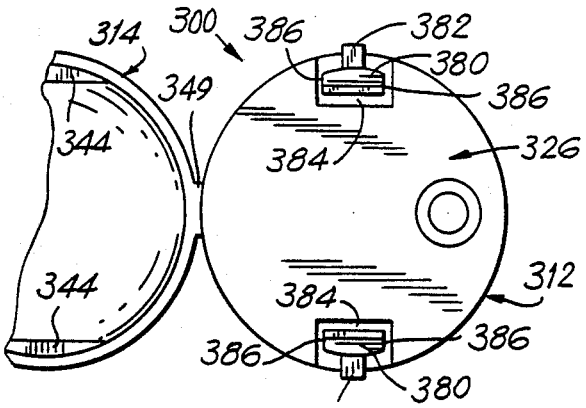
FIG. 12
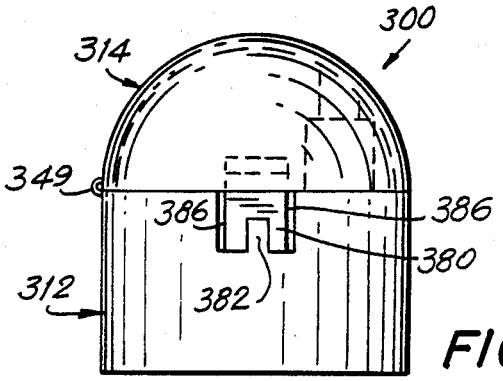
FIG. 13
FIG. 14
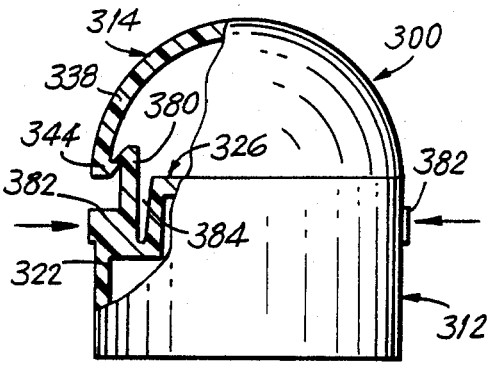
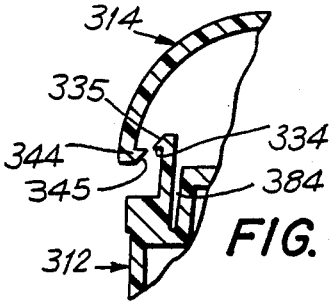
FIG. 15

FIG. 16
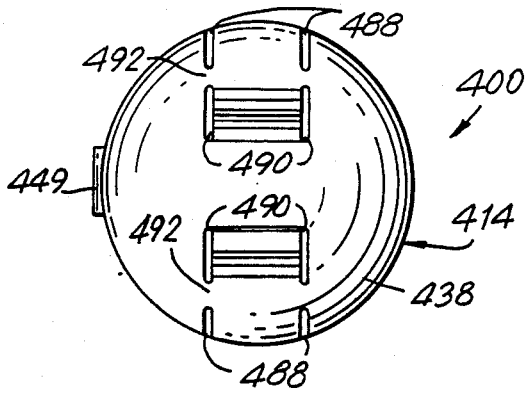
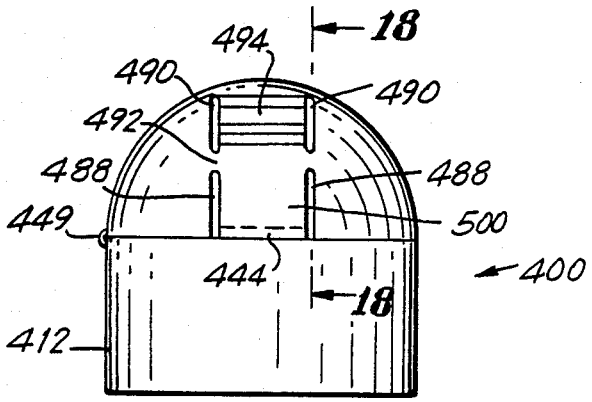
FIG. 17
FIG. 18
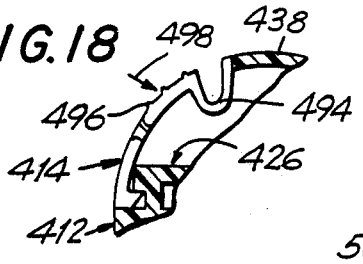
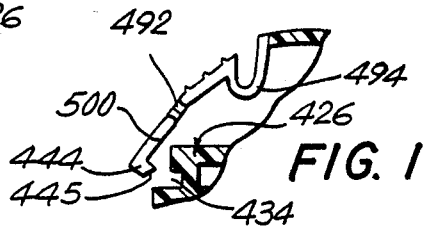
FIG. 19

CHILD RESISTANT CLOSURE

BACKGROUND OF THE INVENTION

1. TECHNICAL FIELD

This invention pertains to closures for containers and the like, and more particularly to child resistant closures.

2. PRIOR ART

So called "child-proof" closures, also known as child resistant closures, are well known. Typically, they are used with containers housing pills, liquids, etc., which could be dangerous if ingested or contacted. In one type of widely used child resistant closure, the cover must be simultaneously pushed downwardly and rotated to open the closure. This closure comprises two independent but inseparable elements, one freely rotatable inside the other. The inner element, which is completely surrounded by the outer element and hence inaccessible to the user, is screwed onto the container. To remove the closure, the outer element is pushed downwardly whereupon mating elements on the outer and inner elements engage. Once engaged, rotation of the outer element rotates the inner element for unscrewing the closure from the container.

While this arrangement serves its intended purpose, it will be apparent that it requires the manufacture of two separate elements, one of which must then be fitted inside the other. Also, each time the container is opened, the closure must be removed from the container with the possibility that the closure may be misplaced.

It is accordingly an object of the present invention to provide an improved child resistant closure.

It is a further object of the present invention to provide a child resistant closure which, in one embodiment, may be manufactured as an integral unit.

It is a further object of the present invention to provide a child resistant closure wherein, in one embodiment, the cover remains secured to the closure even when the closure is open.

SUMMARY OF THE INVENTION

The present invention is for a child resistant closure for a container having an opening. Broadly speaking, the closure comprises a base securable to the container about the opening, the base having an orifice therein communicating with the opening, a first engaging means, and means for fixedly securing the base to the container; and a cover having a second engaging means; one of the cover and the base having a deformable portion, the cover being movable between a closed position wherein the cover obturates the orifice in the base and wherein the first and second engaging means are engaged for retaining the cover in the closed position, and an open position wherein the orifice is exposed, the cover being movable to the open position by deforming the deformable portion which serves to disengage the first and second engaging means.

In a preferred embodiment, the cover is joined to the base by a hinge, such that when the cover is moved to an open position, the cover remains secured to the base thereby preventing it from being misplaced.

The closure of the invention is child resistant, as typically young children do not have the manual dexterity required to deform the deformable portion on the cover or base, and hence will not be able to open the closure. In the preferred embodiments wherein the cover is joined to the base by a hinge, not only does opening require deforming the deformable portion, but requires the additional step of pivoting the cover about the hinge to the open position. In addition to manual dexterity, this procedure requires two hands, and it is therefore expected that embodiments employing a hinge joining the cover to the base will be even more tamper-resistant.

In a preferred embodiment, the first engaging means comprises a ridge on the inside surface of the cover and the second engaging means comprises a recess on the base, the ridge and recess cooperating in the manner of a detent to retain the cover in the closed position.

Further features and advantages of the closure in accordance with the present invention will be more fully apparent from the following detailed description and annexed drawings of the presently preferred embodiments thereof.

BRIEF DESCRIPTION OF THE DRAWINGS

In the drawings:

FIG. 3 is a sectional view taken substantially along the lines 3—3 in FIG. 2;

FIG. 4 is a top plan view of the closure of FIG. 1 shown in the closed position;

FIG. 5 is a fragmentary sectional view taken substantially along the lines 5—5 in FIG. 4;

FIG. 6 is a perspective view of an alternative embodiment in accordance with the present invention;

FIG. 7 is an elevational view, partly in section, showing the closure of FIG. 6 with the cover partially open;

FIG. 8 is a view similar to FIG. 7, but showing the closure of FIG. 6 in its closed position;

FIG. 12 is a top plan view of yet a further embodiment of a closure in accordance with the present invention;

FIG. 13 is an elevational view of the closure of FIG. 12;

FIG. 14 is an elevational view, partly in section, of the closure of FIG. 12;

FIG. 15 is a fragmentary sectional view showing the deformable portion in its deformed condition;

FIG. 16 is a top plan view of a still further embodiment of a closure in accordance with the present invention, shown in its closed position;

FIG. 17 is an elevational view of the closure of FIG. 16;

FIG. 18 is a sectional view taken substantially along the line 18—18 in FIG. 17; and FIG. 19 is a fragmentary sectional view similar to FIG. 18, but showing the deformable portion in its deformed condition.

DETAILED DESCRIPTION OF THE PREFERRED EMBODIMENTS

Figure 1:
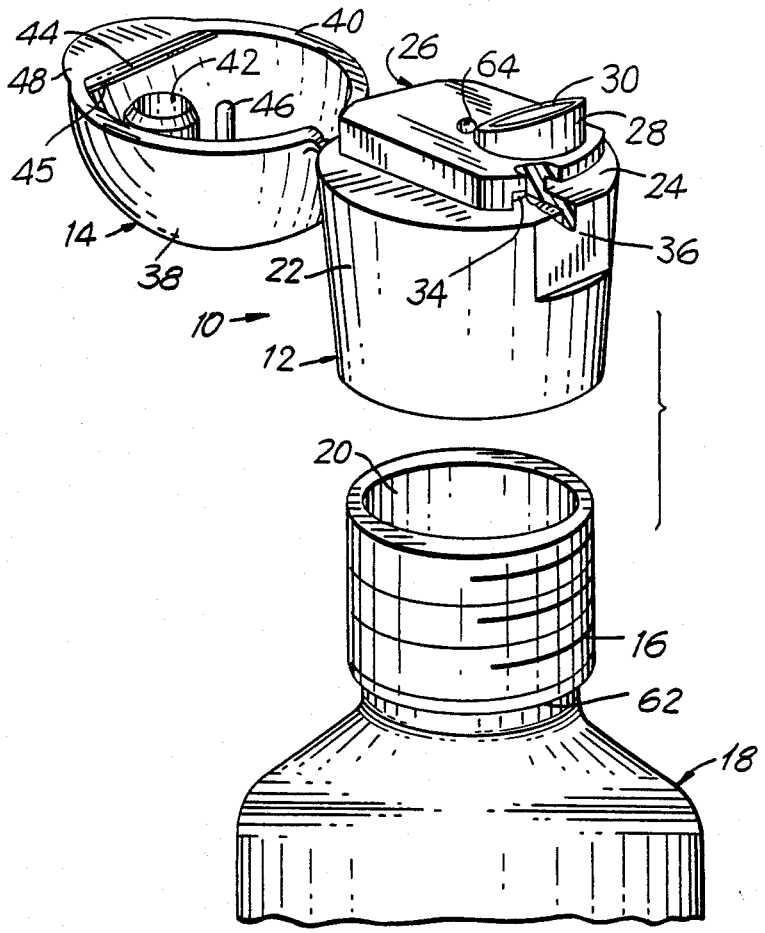
FIG. 1 is a perspective view of a closure in accordance with the present invention, showing also a container to which the closure may be secured.

Referring now to the drawings, and initially to FIGS. 1-5, a child resistant closure in accordance with the present invention is generally designated at 10. As shown, the closure 10 includes a base 12 and a cover 14, the base being securable about the neck 16 of a container 18. In a conventioal manner, the neck 16 defines an opening 20 through which the contents of the container 18 may be dispensed.

The base 12 includes a cylindrical sidewall 22 joined at a shoulder 24 to a raised platform 26. A spout 28 defining an orifice 30 projects upwardly from the platform 26. The orifice 30 extends through the platform 26 such that when the cover 14 is in the open position (See FIGS. 2 and 3), the contents of the container 18 may be poured out through the orifice 30 in a conventional manner. As the closure 10 is particularly suited for dispensing liquids, the top of the spout is angled and its mouth "feathered", the latter providing a fine rim 32 to prevent dripping. The platform 26 may have a vent 64 therein to allow air to enter the container 18 as the liquid contents are poured out. In the absence of the vent 64, the liquid contents of the container 18 would pour out more slowly. The front of the platform 26, i.e. the portion in the vicinity of the spout 28, is provided with an undercut or recess 34 which serves as a first engaging means, the purpose of which will be explained below. As best seen in FIG. 1, the portion of the cylindrical sidewall 22 beneath the undercut 34 may be flattened at 36, also for reasons which will be explained below.

The cover 14 comprises a hemispherical outer wall 38 defining a rim 40 dimensioned for seating on the shoulder 24 when the cover 14 is in the closed position (dotted lines in FIG. 3). As shown, the inside surface of the wall 38 is formed with a pair of cylindrical plugs 42 and 46 which seat in orifice 30 and vent 64, respectively, when the cover is closed for preventing the liquid contents of the container from spilling into the cover 14. The inside surface of the wall 38 is also formed with an inwardly projecting ridge 44 comprising a second engaging means dimensioned for seating in the recess 34. Essentially, the recess 34 and the ridge 44 define a detent. The cover 14 also may include a lip 48 projecting outwardly from the wall 38 opposite the ridge 44. The lip 48, if included, facilitates opening of the closure 10 as will be more fully explained below.

Figure 2:
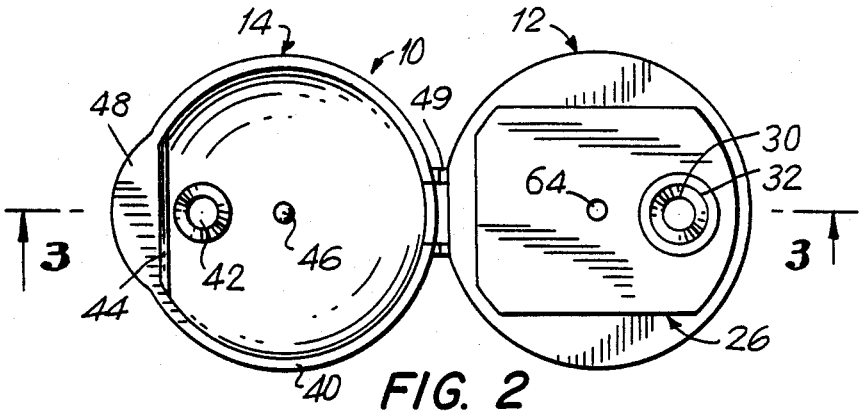
FIG. 2 is a top plan view of the closure of FIG. 1.

As best seen in FIGS. 2 and 3, the cover 14 is joined to the base 12 by a "living" hinge 49 such that the cover 14 is movable between a closed position wherein the contents of the container 18 are sealed therein, and an open position wherein the contents of the container may be disposed through the orifice 30. Employing a living hinge also serves to permanently join the cover to the base such that the cover cannot be misplaced when the closure is open. Preferably, the closure 10 is made of polypropylene and is formed as an integral unit by injection molding.

In accordance with the invention, the sides 50, 52 of the hemispherical wall 38 of the cover 14 are dimensioned for deformation upon the application of a squeezing force of the type applied when the wall portions 50, 52 are squeezed between the thumb and forefinger of an adult. As best seen in FIG. 4, such inward deformation of the wall portions 50, 52 is accommodated by the space 53 between the hemispherical wall 38 and the perimeter of the platform 26 (FIG. 4).

To explain the operation of the closure 10, it will be assumed that the closure is initially in the closed position wherein the cylindrical plugs 42 and 46 seat in orifice 30 and vent 64, respectively, and wherein and the ridge 44 is seated in the recess 34 in the platform 26. In this position, the detent comprised of ridge 44 and recess 34 firmly secures the cover 14 in the closed position, i.e. the cover cannot be forced open simply by applying an upward force to the lip 46. Rather, to open the closure 10, it is necessary to apply a squeezing force to the wall portions 50, 52 sufficient to deform the wall portions 50, 52 inwardly. As best seen in FIGS. 4 and 5, inward deformation of the wall portions 50, 52 effects and an elongation of the hemispherical wall 38 sufficient to disengage the ridge 44 from the recess 34. Then, by simultaneously applying an upward force to the bottom of the lip 48, the ridge 44 may be moved past the platform 26 whereupon the cover 14 may be moved to the open position. During opening, the flattened portion 36 of the cylindrical sidewall 22 of the base 12 provides a supporting surface for the user's thumb as it applies upward pressure to the lip 48. With the cover 14 in the open position, the contents of the container 18 may be poured out through the orifice 30.

From the foregoing, it will be apparent that since opening of the closure 10 requires that the wall portions 50 and 52 be squeezed together while simultaneously applying an upward force to the lip 48, the closure is child resistant as children typically do not have the manual dexterity to simultaneously effect these dual operations. Indeed, it is anticipated that children will not be able to carry out even the first operation, i.e. applying a deforming force to the wall portions 50, 52 sufficient to urge the ridge 44 out of the recess 34. Of course, by selecting the material and thickness of the wall portions 50, 52, the amount of force required to urge ridge 44 out of recess 34 may be predetermined.

To close the closure, the cover 14 is simply pivoted back toward the position shown in phantom in FIG. 3 with sufficient force to slide the ridge 44 over the platform 26 and back into the recess 34. As shown, the bottom surface 45 of the ridge 44 is angled to facilitate the ridge sliding past the platform 26 as the cover is moved to its closed position.

It will by now be apparent that the base 12 must be fixedly secured to the neck 16 of the container 18 to prevent the base 12 from being removed from the container. Otherwise, the child resistant features described above could be defeated by simply removing the closure 10 from the container 18. This may be achieved in a variety of ways. For example, and as illustrated in connection with the preferred embodiment in FIGS. 1-5, the neck 16 is provided with an annular recess 54 which mates with an inwardly projecting annular ridge 56 on the bottom of the base 12. As shown, the diameter of the opening defined by the ridge 56 is slightly smaller than the outer diameter of the portion of neck 16 above the recess 54. The base 12 is joined to the container 18 by forcing the base 12 down over the neck 16. This is facilitated by the angled face 58 on the annular ridge 56. It will be apparent that as the base 12 is slid over the neck 16, the contact between the ridge 56 and the neck 16 results in a slight outward deformation of the cylindrical wall 22. Consequently, when the ridge 56 reaches the annular recess 54, the inherent restoring force of the wall 22 snaps the ridge 56 into the recess 54. Thereafter, the base is fixedly secured to the neck 16 by virtue of the abutment between the annular shoulder 60 on the ridge 56 and the upper defining annular wall 62 of the recess 54.

Those of ordinary skill in the art will recognize that other mechanisms are available for fixedly securing the base 12 to the container 18. For example, a ratchet type arrangement may be employed wherein a plurality of inclined teeth are provided on the outer surface of the neck 16 for cooperation with a plurality of pawls on the internal surface of the cylindrical wall 22 such that once the base 12 is screwed onto the neck 16 it cannot be screwed off. Alternatively, it may be feasible in some applications to form the base 12 integrally with the container 18. Consequently, as used herein the term "fixedly secured", as applied to the securement of the base 12 to the container 18, should be understood as encompassing any technique for preventing the base from being easily removed from the container.

Referring now to FIGS. 6–8, an alternative embodiment of a child resistant closure 100 in accordance with the present invention in shown. The closure 100 is similar to the closure 10 described above, except that the closure 100 incorporates a mechanism for ensuring that the cover 114 does not inadvertently move towards the closed position where it could come into contact with liquid being poured out of the spout 128. To this end, the platform 126 angles upwardly opposite the spout 128 for defining a rear wall 170 which confronts a recess 172 formed in the hemispherical wall 138 of the cover 114. As shown, the base 112 is joined to the cover 114 by a living hinge 149 extending between the shoulder 124 of the base 112 and the bottom defining wall of the recess 172.

Opening and closing of the closure 100 of FIGS. 6–8 is similar to that described above in connection with the closure 10. That is, the closure 100 is opened by squeezing together the wall portions 150, 152 of the cover 114 for deforming the hemispherical wall 138 sufficiently to move the ridge 144 in the cover 114 out of the undercut 134 in the base 112. If the user then simultaneously applies an upward force on the lip 148, the ridge may be moved past the platform 126 for moving the cover 114 toward the open position. As the cover 114 is pivoted toward the open position, the portions 174 on the inside surface of the hemispherical wall 138 on either side of the recess 172 abut and slide along the vertical wall 170. The width of the hinge 149 is selected such that as the wall portions 174 slide along the surface 170, the forces therebetween gradually increases until the cover 114 moves past the point of equilibrium whereupon the cover toggles to the full open position wherein the outer surface of the cover 138 confronts the surface 170.

To close the closure 100, the cover 114 is pivoted towards the closed position. As this occurs, the wall portions 176 on the outside surface of the hemispherical wall 138 on either side of the recess 172 contact the surface 170 and, with increasing force applied to the cover 114 by the user, slide along the surface 170 until the cover 114 toggles to the closed position. By continuing to apply a downward force on the cover 114, the ridge 144 may be snapped back into the recess 134 whereupon the cover is fully closed. As shown, the portion of the hemispherical wall 138 defining wall portions 174, 176 is thickened to prevent excessive deformation of the wall portions 174, 176 as they slide along the surface 170.

It will be apparent from the foregoing that once the cover 114 is opened, it cannot inadvertently move to the closed position, as such movement is blocked by the wall portions 176 contacting the surface 170. Consequently, as the liquid contents of the container (not shown in FIGS. 6–8) are poured out of the spout 128, the cover 114 is precluded from interfering with the pouring operation.

Figure 9:
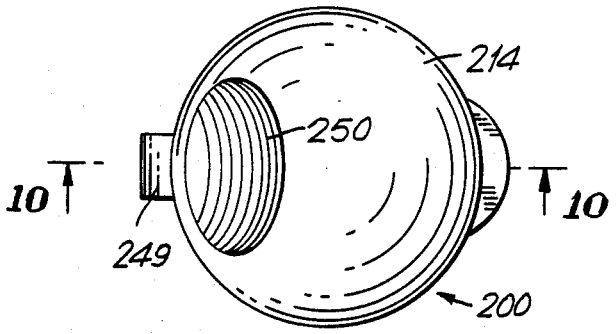
FIG. 9 is a top plan view of yet another embodiment of a closure in accordance with the present invention.
Figure 10:
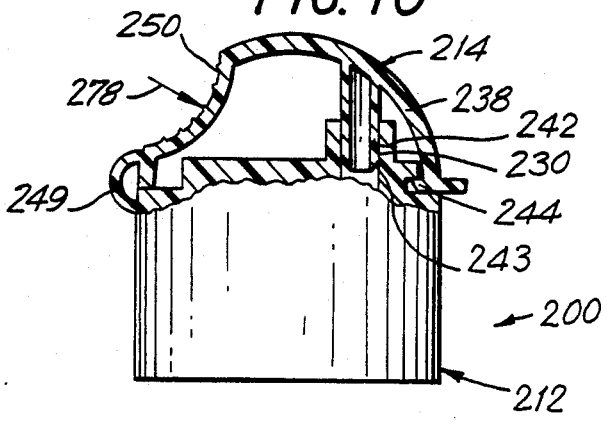
FIG. 10 is an elevational view, partly in section, of the closure of FIG. 9.
Figure 11:
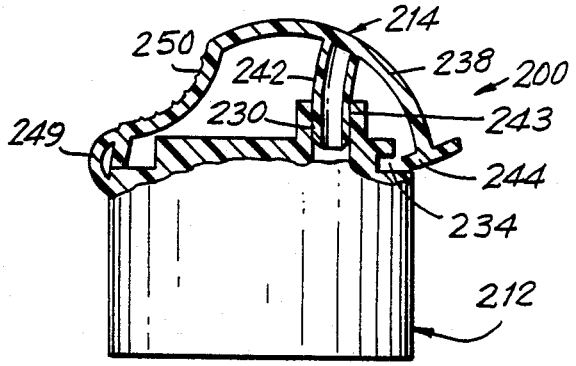
FIG. 11 is a view similar to FIG. 10, but showing the deformable wall portion on the cover in its deformed condition.

Referring now to FIGS. 9–11, a further alternative embodiment of a tamper resistent closure 200 in accordance with the present invention is shown. The closure 200 is similar to the closure 10 of FIGS. 1–5, excepting that in place of the deformable wall portions 50, 52 of the closure 10, the closure 200 incorporates a single, indented deformable wall portion 250 at the rear of the hemispherical wall 238. As shown, the deformable wall portion 250 defines a concave section in the wall 238, preferably dimensioned to receive the tip of a finger, such as the thumb or forefinger.

To open the closure 200, the user applies a force to the deformable wall portion 250 in the direction indicated by the arrow 278. As best seen in FIG. 11, inward deformation of the wall portion 250 serves to urge the ridge 244 out from the recess 234, thereby freeing the cover 214 for pivotal movement about the hinge 249 to the open position. It will be apparent that for the ridge 244 to disengage from the recess 234, the cylindrical plug 242 must be sufficiently flexible to deform in the manner indicated in FIG. 11.

To close the closure 200, the cover 214 is pivoted about the hinge 249 toward the base 212. Before the deformable wall portion 250 is deformed for moving the ridge 244 past the upper defining wall of the recessed 234, the free end 243 of the cylindrical plug 242 must first be inserted in the orifice 230. If the wall portion 250 is deformed first, the plug 242 will be out of alignment with the orifice 230. While a vent and corresponding cylindrical plug, similar to the vent 64 and plug 46 of FIGS. 1–5, are not shown in the embodiment of FIGS. 9–11, they can, of course, be incorporated, again with the proviso that the plug be sufficiently flexible to flex upon deformation of the wall portion 250.

Referring now to FIGS. 12–15, a yet further alternative embodiment of a closure 300 in accordance with the present invention as shown. The closure 300 is conceptually similar to the closures 10, 100 and 200 of FIGS. 1–11, except that in the closure 300, the deformable portion is formed in the base 312 rather than in the hemispherical wall 338 of the cover 314. In particular, a pair of diametrically opposed upstanding bendable members 380 are formed at the top of the base 312 in spaced relation from the platform 326. As shown, the platform 326 essentially surrounds the members 380, being spaced therefrom on either side by gaps 386.

The members 380 are set back from the outer surface of the cylindrical wall 322, and each member 380 defines, at its upper end, an under cut 334. The interior of the hemispherical wall is formed with a pair of inwardly extending ridges 344 aligned with the undercuts 334 and dimensioned such that when the closure 300 is closed, the ridges 344 engage the undercuts 334 for retaining the closure in its closed position.

To open the closure 300, the user grasps the cap 312 between the thumb and forefinger and applies inward pressure, in the direction indicated by the arrows 378 in FIG. 14, at the bases 382 of the members 380. As best seen in FIGS. 14 and 15, the bases 382 extend slightly outwardly from the cylindrical wall 322 for defining the points at which inward pressure should be applied.

As inward pressure is applied on the bases 382, the members 380 deform inwardly (FIG. 15), inward movement of the members 380 being accommodated by the spaces 384 between the members 380 and the platform 326. When a sufficient inward force has been applied, the ridges 344 disengage from the undercuts 334, whereupon the other hand may be used to pivot the cover 314 about the hinge 349 to its open position. As shown, the hinge 349 is equidistant from the members 380.

To close the closure 300, the cover 314 is simply pivoted back about the hinge 349 until the angled faces 345 on the ridges 344 abut the angled faces 335 on the members 380. With continued downward pressure, the members 380 inwardly allowing the ridges 344 to slide past the angled faces 335 until the ridges 344 once again seat in the undercuts 334.

It will therefore be apparent that the closure 300, like the closures discussed above, is child resistant, as it requires dual operations to effect opening. That is, to open the closure 300, not only must the upstanding members 380 be deformed inwardly by applying pressure to the bases 382, but in addition the cover 314 must simultaneously be pivoted about the hinge 349. Children typically do not have the manual dexterity required to perform these operations.

A stil further embodiment of a closure in accordance with the present invention is shown in FIGS. 16–18 and generally designated at 400. As shown, the platform 426 at the top of the base 412 defines a pair of diametrically opposed recesses 434 dimensioned for engagement with a pair of inwardly extending ridges 444 formed on the hemispherical wall 438 of the cover 414. As best seen in FIGS. 16 and 17, two pairs of parallel slits 488 in the wall 438 extend upwardly from the rim 440 on either side of the ridges 444. A second pair of parallel slits 490 is aligned with each pair of slits 488, the slits 490 being spaced from the slits 488 by a strip 492 of the wall 438. A pair of hinge straps 494 are formed in the wall 438 between each pair of slits 490.

To open the closure 400, and as indicated by arrow 498 in FIG. 18, the thumb and forefinger are used to squeeze together the portions 496 of the wall 438 between the strips 492 and the hinge straps 494. As best seen in FIG. 19, this causes the portions 500 of the wall 438 between the slits 488 to pivot radially outward about the strips 492, freeing the ridges 444 from the recesses 434. At this point, the cover 414 can be pivoted about the hinge 449 to its open position.

To close the closure 400, the cover 414 is simply pivoted back towards the base 412 and pressed downwardly until the ridges 444 slide past the platform 426 and back into the recesses 434. Again, the angled faces 445 on the ridges 444 facilitate the ridges sliding past the platform.

While I have herein shown and described several preferred embodiments of a child resistant closure in accordance with the present invention, once this description is known those of ordinary skill in the art will readily appreciate that various changes and modifications may be made therein. For example, while the preferred embodiments of the closure of the present invention are integrally formed by injection molding, this is not necessary, and the cover and base may be formed as separate units not joined by a hinge. If the closure is formed in two parts, the base may, for example, comprise a phenolic. Referring, for example, to the embodiment of FIGS. 1–5, it will be appreciated that the hinge assists in retaining the closure in its closed position by securing one end of the cover 14 to the base 12. Accordingly, if the hinge is dispensed with, the closure must be modified to prevent the cover from being removed without deforming the wall portions 50, 52. In the embodiment of FIGS. 1–5, this could be accomplished by incorporating an additional recess 34 and ridge 44 diametrically opposed to the recess 34 and ridge 44 shown in FIGS. 1–5. That way, the cover 12 could only be removed by deforming the cover sufficiently to retract both ridges from their respective recesses. No such modification would be required for the closures 300 and 400, as the hinges 349 and 449, respectively, do not assist in retaining those closures closed.

Also, while the preferred embodiments are specifically designed for dispensing liquids, it will be appreciated that the invention may be utilized as a child resistant closure for pills and other solid contents. If this is done, in lieu of a spout the base may be provided with an enlarged opening which need not be sealed by a plug formed on the inside of the cover. In such an embodiment, the platform on the base may be eliminated, provided the closure incorporates some mechanism, such as ridge 44 and recess 34 in FIGS. 1–5, for retaining the cover in the closed position. In this regard, while a detent type mechanism for retaining the cover in the closed position is preferred, it too is not mandatory, and any other arrangement incorporating a first engaging means on the cover and a second engaging means on the base which cooperate to retain the cover in the closed position may be employed.

Since these as well as further changes and modifications will be readily apparent to those of ordinary skill in the art, the above description should be construed as illustrative and not in a limiting sense, the scope of the invention being defined by the following claims.

I claim:

1. A child resistant closure for a container having an opening, said closure comprising:

a base securable to said container about said opening, said base having an orifice therein communicating with said opening, a first engaging means, and means for fixedly securing the base to a container;

a cover having a second engaging means engageable with said first engaging means for releasably securing said cover to said base and an inwardly deformable portion which, upon inward deformation, moves said second engaging means outwardly and out of engagement with said first engaging means; and a hinge joining said cover to said base;

said cover being movable about said hinge between a closed position wherein said cover obturates said orifice and wherein said first and second engaging means are engaged, and an open position wherein said orifice is exposed, said cover being movable to said open position by inwardly deforming said deformable portion for disengaging said second engaging means from said first engaging means whereupon said cover may be pivoted about said hinge.

2. The closure according to claim 1, wherein said first and second engaging means are at one end of said base and cover, respectively and wherein said hinge joins said base to said cover at their respective other ends.

3. The closure according to claim 2, wherein said deformable portion comprises the sides of said cover.

4. The closure according to claim 2, wherein said first engaging means comprises a recess in said base and said second engaging means comprises a ridge formed on said cover.

5. The closure according to claim 1, wherein said cover further comprises a plug for obturating said orifice when said cover is in said closed position.

6. The closure according to claim 3, wherein the top of said base comprises a platform defining a shoulder, and wherein said cover seats on said shoulder when said cover is in said closed position, there being sufficient clearance between said platform and said deformable sides of said cover to accommodate inward deformation thereof.

7. The closure according to claim 1, wherein said means for fixedly securing said base to a container comprises an iwardly extending annular ridge dimensioned to seat in an annular recess on the neck of said container.

8. The closure according to claim 6, wherein said cover is generally hemispherically shaped.

9. The closure according to claim 6, further comprising means for toggling said cover between said open and closed positions whereby a closing force sufficient to toggle said cover to said closed position must be applied to move said cover toward said closed position, thereby precluding inadvertent closing of said cover as the contents of said container are dispensed.

10. The closure according to claim 9, wherein said toggling means comprises said platform defining a rear, vertical wall and said cover comprising an additional deformable portion at the rear end thereof, said additional deformable portion sliding along said rear all of said platform through a point of unstable equilibrium as said cover is moved between said open and closed positions, movement of said deformable rear wall portion in either direction beyond said point of unstable equilibrium providing said toggling effect.

11. The closure according to claim 2, wherein said deformable portion is at the rear of said cover.

12. The closure according to claim 11, wherein said cover is generally hemispherically shaped and wherein said deformable portion comprises a concave portion of said cover.

13. The closure according to claim 11, wherein the top of said base comprises a platform defining a shoulder, and wherein said cover seats on said shoulder when said cover is in said closed position, there being sufficient clearance between said platform and said deformable portion to accommodate inward deformation thereof.

14. The closure according to claim 1, wherein said cover has a lower first pair of parallel, spaced apart slits extending to the bottom edge of said cover and an upper first pair of parallel, spaced apart slits aligned with and spaced from said lower pair of slits; a second hinge extending between the upper pair of slits; said first engaging means comprising a recess in said base; said second engaging means comprising a complementary ridge on said cover between said lower pair of slits; said deformable portion comprising the portion of said cover between said upper pair of slits below said second hinge, said deformable portion being inwardly deformable for moving said ridge out of said recess by pivoting the portion of said cover between said lower pair of slits about the portion of said cover separating said lower pair of slits from said upper pair of slits.

15. The closure according to claim 14, wherein said cover is hemispherically shaped.

16. The closure according to claim 14, wherein said cover further comprises a second lower pair of parallel, spaced apart slits and a second upper pair of parallel, spaced apart slits aligned with and spaced from said second lower pair of slits, said second pairs of slits being diametrically opposed to said first pairs of slits; a third hinge extended between said second upper pair of slits; said first engaging means further comprising a second recess in said base; said second engaging means further comprising a second ridge on said cover between said second lower pair of slits, said second ridge being complementary with said second recess; said deformable portion further comprising the portion of said cover between said second upper pair of slits below said third hinge, said deformable portion between said second pair of upper slits being inwardly deformable for moving said second ridge out of said second recess by pivoting the portion of said cover between said second lower pair of slits about the portion of said cover separating said second lower pair of slits from said second upper pair of slits; and wherein said hinge joining said cover to said base is equidistant from said diametrically opposed pairs of slits.

* * * * *